United States Patent [19]

Rérat

[11] Patent Number: 4,930,828

[45] Date of Patent: Jun. 5, 1990

[54] LOAD-SUSPENSION ARRANGEMENT FOR HOISTING APPARATUS

[75] Inventor: Charles Rérat, Courtedoux, Switzerland

[73] Assignee: Recomatic SA, Courtedoux, Switzerland

[21] Appl. No.: 320,542

[22] Filed: Mar. 8, 1989

[30] Foreign Application Priority Data

Mar. 24, 1988 [CH] Switzerland ..... 1107/88

[51] Int. Cl.[5] ..... B66C 1/34

[52] U.S. Cl. ..... 294/82.15; 188/318

[58] Field of Search ..... 294/82.15, 82.16; 188/299, 312, 317–319, 321.11, 322.13, 322.15, 322.18; 267/124–127, 129, 226

[56] References Cited

U.S. PATENT DOCUMENTS

| | | | |
|---|---|---|---|
| 1,560,477 | 11/1925 | Kessler | 188/318 |
| 2,500,459 | 3/1950 | Hoover et al. | 294/82.15 X |
| 2,860,908 | 11/1958 | Peterson | 294/82.15 |
| 4,724,970 | 2/1988 | Kuhn | 294/82.16 X |

FOREIGN PATENT DOCUMENTS

| | | | |
|---|---|---|---|
| 941021 | 3/1956 | Fed. Rep. of Germany | 294/82.16 |
| 2317555 | 10/1974 | Fed. Rep. of Germany . | |
| 1497666 | 10/1967 | France | 294/82.15 |
| 388995 | 7/1973 | U.S.S.R. | 294/82.15 |
| 895885 | 1/1982 | U.S.S.R. | 294/82.15 |
| 1184789 | 10/1985 | U.S.S.R. | 294/82.15 |
| 1271812 | 11/1986 | U.S.S.R. | 294/82.16 |
| 1413202 | 11/1975 | United Kingdom | 294/82.15 |

*Primary Examiner*—Johnny D. Cherry
*Attorney, Agent, or Firm*—Oliff & Berridge

[57] ABSTRACT

Two rod portions (30, 31) are integral with a piston (3) which can slide in a cylinder (1) when a cone-point screw device (8) is partially open, the result of which is a translatory motion downward, of adjustable speed, of the load hooked to the cylinder by a shackle (21). The speed of translation can be controlled in such a way that the load is lowered onto its location very gently and without jolting.

10 Claims, 4 Drawing Sheets

LOAD-SUSPENSION ARRANGEMENT FOR HOISTING APPARATUS

This invention relates to hoisting apparatus, and more particularly to load-suspension apparatus of the type comprising a cylinder-piston assembly of which each of the parts, the cylinder and the piston, is provided with hooking means, permitting one of them to be hooked to the hoisting apparatus and the other to the load, and further comprising an adjustable flow-control means of communication between the two ends of the cylinder in such a way that under the influence of the load, an incompressible; fluid occupying the cylinder flows through the flow control means at a regulated rate of flow, thus regulating a constant-speed displacement of the piston in the cylinder.

It is well known how difficult it is to set down loads on machine tools or other machines without jolting when using a hoisting apparatus such as a block and tackle, a traveling crane, or a stationary crane. To overcome this difficulty, arrangements of the above-mentioned type have already been proposed.

By regulating the cross-section of a flow control means, often by means of a cone-point screw, the prior art arrangements are intended to ensure displacement of the load at a slow, steady, controlled speed which can be precisely cut off at the moment when the load comes in contact with the base on which it is to rest.

Arrangements of this type are described particularly in U.S. Pat. Nos. 2,500,459 and 2,860,908, German Patent No. 941,021, German Laid-Open Application (DOS) No. 2,317,555, and French Patent No. 1,497,666.

However, none of the arrangements described in these prior disclosures has proved to be easy to use and reliable in practice, so that there is still need of an arrangement actually satisfying the indicated requirements.

It is an object of this invention to provide an improved load-suspension arrangement which meets this need.

It is a further object of this invention to provide a load-suspension arrangement which ensures the fluid-tightness of the piston within the cylinder for the entire duration of a period of long use despite the violent shocks and stresses to which such arrangements are subjected in operation.

Another object of this invention is to provide the load-suspension arrangement with an improved adjustable flow control means which permits stopping the movement of the load at will and restarting it without modifying the adjusted position of the flow control means.

To this end, in the load-suspension arrangement according to the present invention, of the type initially mentioned, the improvement comprises a piston including a piston disk integral with two coaxial rod portions, the cylinder having two end flanges, each provided with a guide aperture having fluid-tight means comprising one or more than one annular-grooves opening out into said guide apertures and provided with gasket rings, each piston rod traversing one of the apertures so as to achieve a fluid-tight guidance ensuring a perfectly coaxial relative displacement between the cylinder and the piston.

Preferred embodiments of the invention will now be described in detail with reference to the accompanying drawings, in which.

Figure 2:
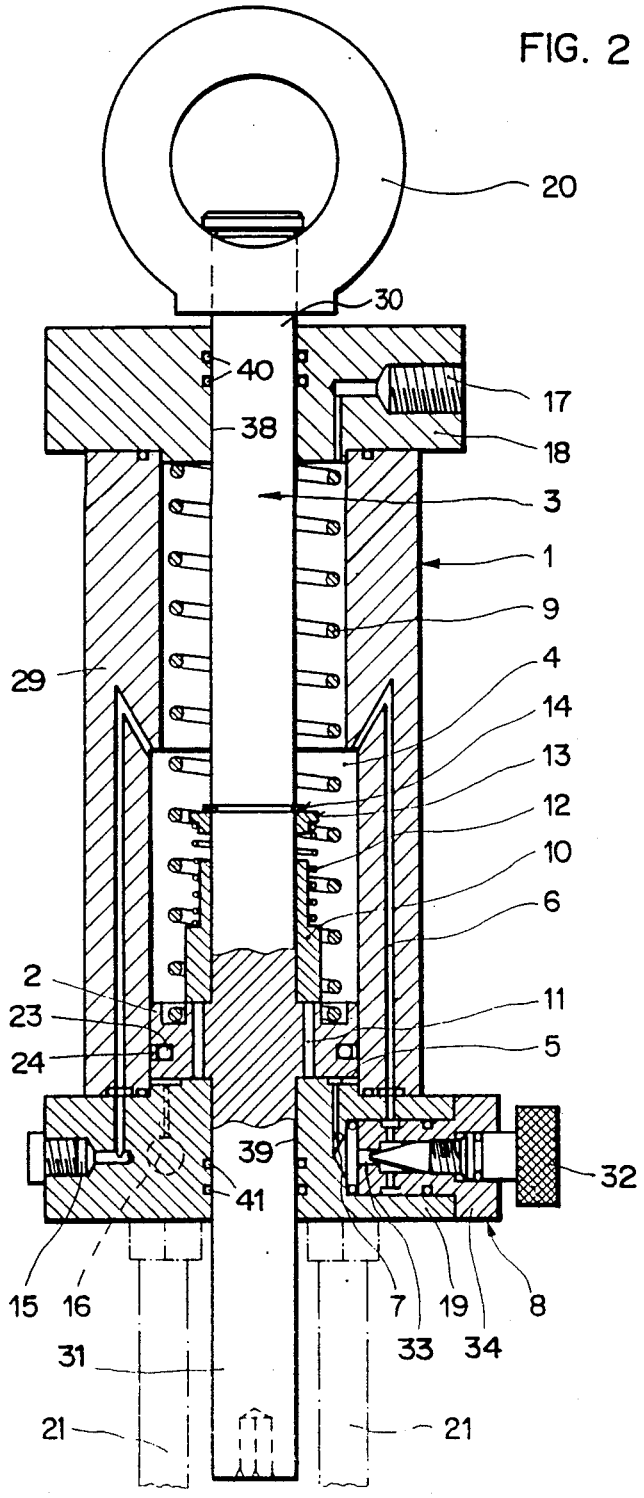
FIG. 2 is an axial section through one embodiment of the arrangement.

FIG. 2 shows the main elements making up one embodiment of the invention. The arrangement is composed of a cylinder 1 in which there slides a piston 3 guided by bores provided in flanges 18 and 19 forming the ends of the cylinder. Besides flanges 18 and 19, cylinder 1 comprises a ferrule 29 forming its sidewall. Piston 3 comprises, in one piece, a piston disk 2 and two coaxial rod portions 30 and 31 which extend on either side of piston disk 2 and pass through guide apertures 38 and 39 in flanges 18 and 19. Said apertures have formed therein fluid-tight means comprising one or more than one annular grooves 40 and 41 opening out into said guide apertures and provided with gasket rings. Fixed to the top of rod 30 is an eye 20, while a lifting shackle 21 is fixed to flange 19. Eye 20 is hooked to the hoisting apparatus (block and tackle or other hoist), while the load to be lifted is fixed to shackle 21.

Figure 1:
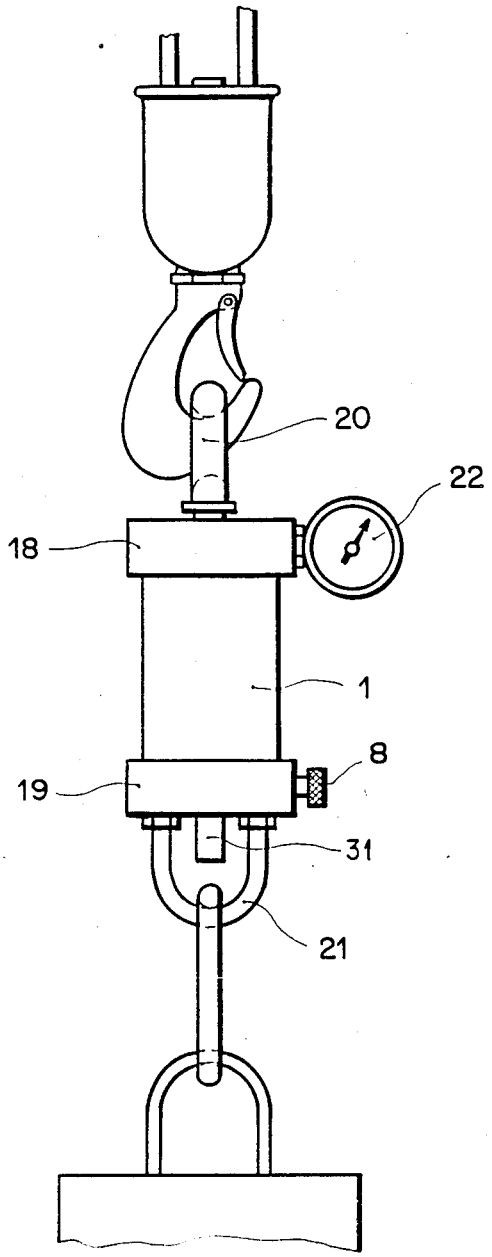
FIG. 1 is an elevation of the suspension arrangement in working position, hooked to a hoist and supporting a load.

Piston disk 2 delimits two chambers, a main chamber 4 and a secondary chamber 5. Chambers 4 and 5 communicate with one another by means of ducts 6 and 7, on the one hand, between which a flow control device 8 with a cone-point screw 32 is placed, shut off in resting position; and by means of ducts 11, on the other hand, shut off by a valve 10 when the arrangement is supporting a load. Cylinder 1 is filled with oil; and when the arrangement is supporting a load, i.e., when traction is applied to shackle 21, and when screw 32 of device 8 is screwed in, i.e., when its tip shuts off a duct portion 33 in a fixed body 34 of device 8, the oil in main chamber 4 is put under pressure, which produces a force on the top surface of valve 10. A spring 12 keeps valve 10 closed, and piston 3 remains in a fixed position relative to cylinder 1. A manometer 22 (FIG. 1) graduated in units of force and connected to an orifice 17 gives the weight of the load suspended from the arrangement, the hydraulic pressure being directly proportional to the load applied.

When it is desired to lower the load, it suffices to open the connection between ducts 6 and 7 by unscrewing cone-point screw 32, thus allowing the oil contained in main chamber 4 to flow into secondary chamber 5, thereby causing a downward translation of cylinder 1 and, consequently, of the load. The speed of descent is controlled by the degree to which duct 33 is opened by the conical tip of screw 32 which regulates the quantity of oil flowing from the upper chamber toward the lower chamber. The cone-point screw may be provided with graduations facilitating repeated regulation of the speed of descent of a given load.

As soon as the arrangement is no longer acted upon by the load, a return spring 9 pushes cylinder 1 upward again, valve 10 opening and clearing the passage constituted by one or more than one bores 11. Secondary chamber 5 is consequently emptied through this valve, and main chamber 4 fills with oil. When substantially all the oil has thus been transferred to main chamber 4, valve 10 is closed again by its return spring 12 which is fixed to rod 30 by a seat 13 and an elastic ring 14. The suspension arrangement is again ready to operate after the conical point has been closed. It should be noted that the arrangement may be used in reverse position, i.e., the cylinder may be hooked to the hoist by its lifting shackle 21, and the load may be hooked to the eye 20 integral with the rod, the function of the arrangement remaining identical. Furthermore, cone-point screw device 8 may be replaced by any other flow-regulating means (e.g., ball regulator). In addition, the manually operated regulating device may be replaced by a regulating device remotely controlled by means of an electric stepping motor, a pneumatic motor, or any other servo means.

Two threaded orifices 15 and 16, one communicating with main chamber 4 and the other with secondary chamber 5, are provided for installing such a remote control via two tubes 35 and 36 connected at one end to these orifices and at the other to a remote flow-regulating means 37, e.g., having a conical point screw mechanism 37*a*.

The gasket of piston 3 is designed for ensuring fluid-tightness at high pressure while having a minimum coefficient of friction against the inside surface of cylinder 1. In the foregoing embodiment, it is made up of two elements: an O-ring 23 and an annular gasket 24 of rectangular cross-section made of PTFE or the like. The fluid-tightness principle of this assembly is as follows: the groove constituting the cage of these gaskets is slightly wider than gasket 24; O-ring 23 is placed in the bottom of this groove, and annular gasket 24 is seated in such a way as to cover the O-ring. When main chamber 4 is under pressure, the oil flows into the groove, exerting pressure upon O-ring 23, which is deformed and starts to exert pressure against gasket 24, which is in turn flattened against the inside of the wall 29 of cylinder 1, thereby ensuring optimum fluid-tightness and a low coefficient of friction between annular gasket 24 and wall 29 of cylinder 1 owing to the inherent characteristics of the material of which gasket 24 is made. These two factors—absolute fluid-tightness and smooth sliding of piston 3 in cylinder 1—are characteristics essential to the good functioning of the inventive suspension arrangement.

Moreover, a safety element, preventing the load from dropping at high speed when the conical point is open to the maximum, is provided by means of a reduction in the cross-section of one of the ducts 6 or 7 over a short distance, this narrowing (not shown) having the effect of decreasing the rate of flow passing through these ducts and consequently limiting the piston-cylinder translation speed. A similar reduction of cross-section is provided in one or the other of the ducts connected to orifices 15 and 16.

It will be readily understood that provision is also made for a hydraulic-fluid filling inlet and an air-exhaustion outlet (not shown).

Figure 3:
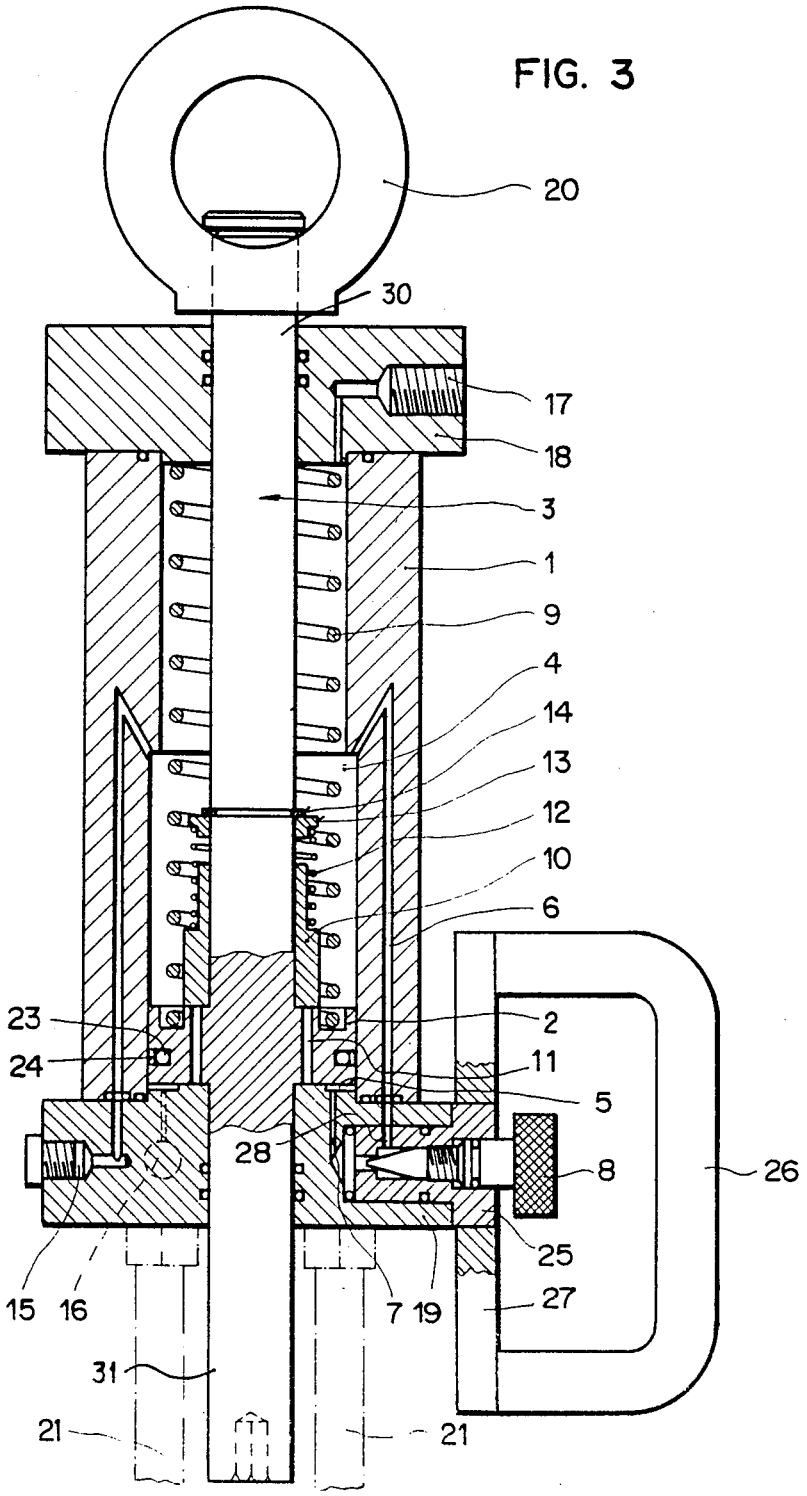
FIG. 3 is an axial section through another embodiment of the arrangement.
Figure 4:
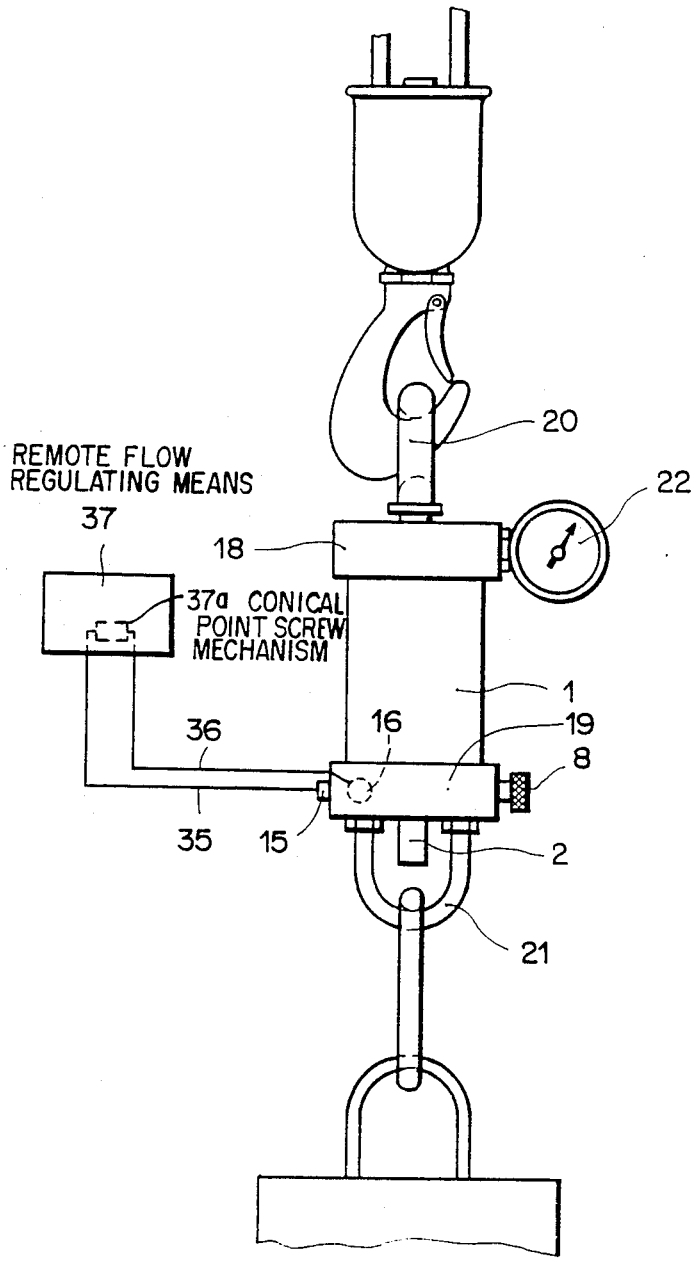
FIG. 4 is a view similar to FIG. 1, showing the arrangement equipped with a remote control system.

FIG. 3 shows another embodiment of the inventive suspension arrangement in which an additional element has been incorporated in the arrangement as described above. Fixed body 34 of the first embodiment is replaced here by a body 25 having the same shape, but which is rotatingly mounted within flange 19. The additional element is a handle 26 integral with a part 27 rigidly coupled to body 25 of cone-point screw device 8. Handle 26 has a dual function. For one thing, it permits easier manipulation of the hoist with only one hand, and hence easy guidance of the load suspended from the hoist. For another thing, the second function of handle 26 is to open or close the passage for the oil from main chamber 4 to secondary chamber 5 in the following way: the spigot body 25 of the seat of the cone-point screw is fixed to flange 19 in such a way as to allow partial rotation of body 25 in its recess. A simple device known per se makes it possible to achieve this effect, e.g., a dog-point screw driven into flange 19 with its dog point fitting into a groove machined in body 25.

Partial rotation of handle 26 will result, for a first position, in blockage of the passage of oil from main chamber 4 to secondary chamber 5, the axes of ducts 6 and 28 no longer being aligned and the ducts no longer communicating, or for a second position, of allowing passage of the oil from main chamber 4 to secondary chamber 5 when the rotation of handle 26 and, consequently, of body 25 is such that the axes of ducts 6 and 28 are aligned. The rate of flow of the oil can be regulated beforehand with the aid of device 8 and need no longer be necessarily modified in the event of repeated use of the device under similar conditions.

As may readily be observed, this arrangement, which needs no outside power supply, contributes great ease of placement of loads in material handling, for it allows them to be lowered very gently to their location. The arrangement may be designed in various sizes, diameters, lengths of stroke, and forms, as well as for different load values. It is reliable in operation and withstands the shocks inevitably ensuing from its use.

What is claimed is:

1. An arrangement for suspending a load from hoisting apparatus, of the type comprising a cylinder having two ends, a piston disposed within the cylinder, hooking means provided on the cylinder and on the piston for hooking either one to the hoisting apparatus and the other to the load, conduit means connecting the two ends of the cylinder, and adjustable flow-control means disposed in said conduit means, said conduit means permitting an incompressible fluid contained in the cylinder to flow through the flow-control means at a controlled rate of flow for displacing the piston within the cylinder at a constant rate, wherein the improvement comprises:

a piston rod composed of two coaxial rod portions, a piston disk forming part of said piston and integral with said rod portions, two end flanges forming part of said cylinder and including respective guide apertures, and fluid-tight means associated with each of said apertures, each of said piston rod portions traversing one of said apertures.

2. The arrangement of claim 1, comprising flow-control means including a bore portion including a wall forming part of said conduit means and a cone-point screw capable of fitting partially in said bore portion, said flow-control means being composed of the conical point of said screw and said wall of said bore portion.

3. The arrangement of claim 2, wherein said conduit means comprise a spigot body, a handle integral with said body, a recess contrived in the outer surface of said cylinder, a first and a second duct both opening out in said spigot body, said spigot body being equipped with said screw and being mounted in said recess in such a way that in a first position of said handle, said spigot body opens said conduit means and ensures a controlled rate of flow in said flow-control means, whereas in a second position of said handle, said spigot body closes said conduit means.

4. The arrangement of claim 1, wherein each of said guide apertures includes a bore matching one of said rod portions and said fluid-tight means comprises at least one annular groove opening out into said bore and provided with a gasket ring.

5. The arrangement of claim 1, further comprising a return means for returning said piston to a starting position upon contact with one of said flanges in the absence of a load on the respective hooking means.

6. The arrangement of claim 5, wherein said return means is a spring placed between said piston and one of said flanges, further comprising a valve, said piston disk comprising a high-flow passage accommodating said valve and permitting a rapid return of said piston into said starting position.

7. The arrangement of claim 6, wherein said valve is composed of a sleeve mounted on the one of said rod portions traversing the space occupied by said return spring, said sleeve being in turn biased by a spring connected to said one rod portion, said sleeve shutting off at least one bore traversing said piston and together forming said high-flow passage.

8. The arrangement of claim 1, wherein said piston is provided with a gasket assembly composed of an O-ring and an annular gasket of rectangular cross-section.

9. The arrangement of claim 1, wherein said conduit means comprise two discrete ducts provided with adjustable flow control means, one of said ducts being arranged to permit the installation of a remote control.

10. The arrangement of claim 9, wherein the flow-control means comprises cone-point screw mechanisms for fine adjustment of the flow rate of the fluid through the two conduit ducts.

* * * * *